US007788855B2

(12) United States Patent
Mileti et al.

(10) Patent No.: US 7,788,855 B2
(45) Date of Patent: Sep. 7, 2010

(54) CORNER FLASHING

(75) Inventors: Robert J. Mileti, Torrington, CT (US); Kathleen Celeste Boivin, Rehoboth, MA (US)

(73) Assignee: Fortifiber Corporation, Incline Village, NV (US)

( * ) Notice: Subject to any disclaimer, the term of this patent is extended or adjusted under 35 U.S.C. 154(b) by 1297 days.

(21) Appl. No.: 10/870,746

(22) Filed: Jun. 17, 2004

(65) Prior Publication Data

US 2005/0279044 A1 Dec. 22, 2005

(51) Int. Cl.
*E04B 1/70* (2006.01)

(52) U.S. Cl. ..... 52/58; 52/745.19; 52/302.6

(58) Field of Classification Search ..... 52/58, 52/62, 302.6, 204.53, 204.54, 60–61, 97, 52/717.01, 717.03, 717.05; 49/471, 476.1
See application file for complete search history.

(56) References Cited

U.S. PATENT DOCUMENTS

| | | | | | |
|---|---|---|---|---|---|
| 160,284 | A | | 3/1875 | Rowland | |
| 2,095,072 | A | * | 10/1937 | Ludden | 52/62 |
| 3,451,178 | A | | 6/1969 | Beale | |
| 4,555,882 | A | * | 12/1985 | Moffitt et al. | 52/209 |
| 4,700,512 | A | | 10/1987 | Laska | |
| 4,837,997 | A | | 6/1989 | Zeilinger | |
| 5,018,333 | A | * | 5/1991 | Bruhm | 52/741.4 |
| 5,109,641 | A | * | 5/1992 | Halan | 52/62 |
| 5,189,853 | A | | 3/1993 | Braine et al. | |
| 5,542,217 | A | * | 8/1996 | Larivee, Jr. | 49/471 |
| 5,586,415 | A | * | 12/1996 | Fisher et al. | 52/58 |
| 5,815,986 | A | * | 10/1998 | Laska | 52/62 |
| 6,119,416 | A | | 9/2000 | Larson | |
| 6,385,925 | B1 | * | 5/2002 | Wark | 52/209 |
| 6,401,401 | B1 | * | 6/2002 | Williams | 52/58 |
| 6,401,402 | B1 | | 6/2002 | Williams | |
| 6,806,317 | B2 | * | 10/2004 | Morishita et al. | 525/314 |
| 7,059,087 | B2 | * | 6/2006 | Allen | 52/58 |
| 2001/0034984 | A1 | * | 11/2001 | Murphy et al. | 52/204.5 |
| 2003/0177725 | A1 | * | 9/2003 | Gatherum | 52/302.1 |
| 2005/0262782 | A1 | * | 12/2005 | Harrison et al. | 52/204.53 |
| 2006/0075700 | A1 | * | 4/2006 | Broad et al. | 52/212 |

* cited by examiner

*Primary Examiner*—Robert J Canfield
*Assistant Examiner*—Christine T Cajilig
(74) *Attorney, Agent, or Firm*—Price, Heneveld, Cooper, DeWitt & Litton, LLP

(57) ABSTRACT

A window corner flashing device includes a first and a second member. The first member includes a first section which is disposed adjacent a second section and is angled thereto. The first section and second section have a first edge and second edge, respectively, wherein the first member includes a first continuous flange disposed along the first and second edges of the first and second sections, respectively. The second member includes a first section having a third edge and a second section having a fourth edge. The second member further includes a first continuous mating edge which is disposed along the third and the fourth edge thereof. The first member is affixed to the second member by having the first continuous flange permanently affixed to the first continuous mating edge.

57 Claims, 8 Drawing Sheets

CORNER FLASHING

BACKGROUND OF THE INVENTION

The present invention generally relates to a window or door construction and more particularly to a flashing for sealing window frames, door frames and the like.

"Flashing" is a term used to identify the methods and devices, which are utilized to prevent water and air infiltration. In recent years, numerous methods and devices have been made in an effort to provide a solution to the problem of water and air infiltration, particularly with regard to windows and doors in either residential or commercial construction. Controlling water and air intrusion is a serious concern and if not done properly may result in damage to the construction. In addition, heat transfer because of air infiltration is a significant factor in reducing the energy efficiency of these buildings. Therefore, a need exists for flashing methods and devices used therein, which can reduce or eliminate the unwanted infiltration of water and/or air while remaining relatively low in cost and easy to use.

In the past, one method for dealing with the potential for water intrusion was to expect that some water will enter the exterior wall openings and therefore, utilize methods and products for flashing that minimize the amount of water/air infiltration while simultaneously allowing water that has infiltrated the construction to be removed by permeating through the flashing. Water vapor permeance is a measure of the amount of water vapor which can permeate or escape through a particular material. The American Society for Testing and Materials (ASTM) has developed a standard test method for water vapor transmission (E-96-00). Generally speaking, a vapor permeance of less than about 0.3 perms is considered a low permeance value, whereas a vapor permeance greater than about 0.4 perms is considered a high permeance value. Therefore, flashing products which provide for the permeation of collected water will typically have a vapor permeance of 0.4 or greater. Such products have been described in U.S. Patent Application Publication No. U.S. 2001/0034984 A1.

In the alternative, a sealed approach has been developed wherein the window or door frames are completely sealed from the exterior environment in an effort to prevent the inward migration of water and air from occurring in the first place. Such barriers are available as Moistop E-Z Seal® from the Fortifiber Corporation of Incline Village, Nev. The Moistop E-Z Seal® has a vapor permeance of less than about 0.3 perms. Additional barriers include Moistop® Flashing (<0.3 perms), Moistop neXT™ Flashing (<0.05 perms) and Fortiflash (<0.08 perms), all available from the Fortifiber Corporation.

The flashing methods and devices heretofore used require on site fabrication and/or additional sealing steps to ensure that the flashing device is properly sealed. These additional steps increase the difficulty of installation as well as increasing costs. Therefore, a need exists for a flashing product which is easy to install, robust, and cost effective.

SUMMARY OF THE INVENTION

The aforementioned drawbacks and shortcomings of the prior art are elegantly solved with the corner flashing system of the present invention, which provides a window corner flashing device which includes a first and a second member. The first member includes a first section which is disposed adjacent to a second section and is angled thereto. Each of the first section and second section have a first edge and second edge, respectively, wherein the first member includes a first continuous flange disposed along the first and second edges of the first and second sections, respectively. The second member includes a first section having a third edge and a second section having a fourth edge. The second member further includes a first continuous mating edge which is disposed along the third and the fourth edge thereof. The first member is affixed to the second member by having the first continuous flange permanently affixed to the first continuous mating edge.

Another aspect of the present invention is to provide a window corner flashing device which includes a first and a second flashing member. The first flashing member includes a first section which further includes a first edge, and a second section including a second edge. The first and second edges are disposed adjacently to define a first continuous edge therealong. Further, the first section is disposed at a first angle with respect to the second section. The second flashing member includes a third and a fourth edge, wherein the third edge is disposed at a second angle with respect to the fourth edge. The second angle generally equals the first angle and the third and fourth edges are adjacently disposed to define a second continuous edge. A continuous flange is disposed along at least one of the first continuous edge or the second continuous edge, wherein the continuous flange disposed along the at least one of the first continuous edge or the second continuous edge is affixed to the other of the second continuous edge or the first continuous edge.

Yet another aspect of the present invention is to provide a window corner flashing device which includes a first and a second flashing member. The first flashing member includes a first section comprising a first edge and a second section comprising a second edge. The first and second edges are disposed adjacently to define a first continuous edge therealong, wherein the first section is disposed generally orthogonal with respect to the second section. The second flashing member includes a third and fourth edge, wherein the third edge is disposed generally orthogonal to the fourth edge. The third and fourth edges are adjacently disposed to define a second continuous edge therealong. A continuous flange is disposed along at least one of the first continuous edge or the second continuous edge, wherein the continuous flange disposed along the at least one of the first continuous edge or the second continuous edge is affixed to the other of the second continuous edge or the first continuous edge such that the first member may be disposed generally orthogonally to the second member.

Still another aspect of the present invention is to provide a window corner flashing device which includes a first and a second member. The first flashing member includes a first section comprising a first edge and a second section comprising a second edge. The first and second edges are disposed adjacently to define a first continuous edge therealong, wherein the first section is disposed at a first angle with respect to the second section. The second flashing member includes a third section comprising a third edge and a fourth section comprising a fourth edge. The third and fourth edges are disposed adjacently to define a second continuous edge therealong, wherein the third edge is disposed at a second angle with respect to the fourth edge. A continuous flange is disposed along at least one of the first continuous edge or the second continuous edge, wherein the continuous flange which is disposed along the at least one of the first continuous edge or the second continuous edge is affixed to the other of the second continuous edge or the first continuous edge.

One aspect of the present invention is to provide a window corner flashing device which includes a first and a second member. The first flashing member includes a first section comprising a first edge and a second section comprising a second edge. The first and second edges are disposed adjacently to define a first continuous edge therealong, wherein the first section is disposed at a generally orthogonal angle with respect to the second section. The second flashing member includes a third section comprising a third edge, and a fourth section comprising a fourth edge, wherein the third and fourth edges are disposed adjacently to define a second continuous edge therealong. The third edge is disposed at a generally orthogonal angle with respect to the fourth edge. Further, a continuous flange is disposed along at least one of the first continuous edge or the second continuous edge, wherein the continuous flange disposed along the at least one of the first continuous edge or the second continuous edge is affixed to the other of the second continuous edge or the first continuous edge such that the first member may be disposed generally orthogonally to the second member.

Another aspect of the present invention is to provide a method for creating a window corner flashing device and includes providing a first flashing member which includes a first section comprising a first edge and a second section comprising a second edge, wherein the first and second edges are disposed adjacently to define a first continuous edge therealong. The first section is then bent at a first angle with respect to the second section. A second flashing member is provided which includes a third and a fourth edge, wherein the third edge is disposed at a second angle with respect to the fourth edge and wherein further the second angle generally equals the first angle. The third and fourth edges are adjacently disposed to define a second continuous edge. A continuous flange is formed along at least one of the first continuous edge or the second continuous edge and then affixed to the other of the second continuous edge or the first continuous edge.

Yet another aspect of the present invention is to provide a method for creating a window corner flashing device and includes providing a first flashing member including a first section comprising a first edge and a second section comprising a second edge. The first and second edges are disposed adjacently to define a first continuous edge therealong and the first section is bent to a first angle with respect to the second section. The second flashing member is provided with and includes a third and a fourth edge, wherein the third edge is disposed at a second angle with respect to the fourth edge. The second angle is generally equal to the first angle and the third and fourth edges are adjacently disposed to define a second continuous edge. At least one of the first continuous edge or the second continuous edge is heated and at least one of the first continuous edge or the second continuous edge is formed to provide a continuous flange along the at least one of the first continuous edge or the second continuous edge. The continuous flange disposed along the at least one of the first continuous edge or the second continuous edge is affixed to the other of the second continuous edge or the first continuous edge.

Still another aspect of the present invention is to provide a method for creating a window corner flashing device and includes providing a first flashing member including a first section comprising a first edge and a second section comprising a second edge. The first and second edges are disposed adjacently to define a first continuous edge therealong. The first section is bent to a first angle with respect to the second section. A second flashing member is provided and includes a third section comprising a third edge and a fourth section comprising a fourth edge, wherein the third and fourth edges are disposed adjacently to define a second continuous edge therealong. The third edge is disposed at a second angle with respect to the fourth edge. A continuous flange is formed along at least one of the first continuous edge or the second continuous edge and affixed to the other of the second continuous edge or the first continuous edge.

Yet another aspect of the present invention is to provide a method for creating a window corner flashing device and includes providing a first flashing member including a first section comprising a first edge and a second section comprising a second edge, wherein the first and second edges are disposed adjacently to define a first continuous edge therealong. The first section is bent to a first angle with respect to the second section. A second flashing member is provided and includes a third section and a fourth section. The third section and the fourth section are cut to define a V-shaped notch comprising a third edge and a fourth edge, wherein the third and fourth edges are disposed adjacently to define a second continuous edge therealong. The third edge is disposed at a second angle with respect to the fourth edge. At least one of the first continuous edge or the second continuous edge is heated and formed to provide a continuous flange along the at least one of the first continuous edge or the second continuous edge. The continuous flange disposed along the at least one of the first continuous edge or the second continuous edge is affixed to the other of the second continuous edge or the first continuous edge.

Yet still another aspect of the present invention is to provide a flashing device and includes a first flashing member comprising a first section including a first edge, a second section including a second edge, and a third section including a third edge. The first, second and third edges are disposed adjacently to define a first continuous edge therealong, and the first and second sections are disposed at a first angle with respect to the third section. A second flashing member includes a fourth, a fifth and a sixth edge, wherein the fourth and fifth edges are disposed at a second angle with respect to the sixth edge. The second angle is generally equal to the first angle. The fourth, fifth and sixth edges are adjacently disposed to define a second continuous edge. A continuous flange is disposed along at least one of the first continuous edge or the second continuous edge, wherein the continuous flange disposed along at least one of the first continuous edge or the second continuous edge is affixed to the other of the second continuous edge or the first continuous edge.

One aspect of the present invention is to provide a flashing device which includes a flashing member comprising a first polymer layer and a second adhesive layer. The second adhesive layer includes a non-adhering portion surrounded by the adhesive portion on at least three sides thereof and the non-adhering portion extends to at least one edge of the flashing member.

Yet another aspect of the present invention is to provide a method for creating a flashing device and includes providing a flashing member which comprises a first polymer layer and a second adhesive layer. The second adhesive layer includes a non-adhering portion surrounded by the adhesive portion on at least three sides thereof. The non-adhering portion is disposed at least partially along one edge of the flashing member. At least part of the adhesive layer is affixed to a bottom outside flange of a window frame or a door frame and to an outside bottom face of a construction below a building structural aperture wherein the window frame or door frame is installed. At least part of the non-adhering portion is disposed adjacent to the outside flange of the window frame or the door frame, and at least part of the non-adhering portion which is disposed along the at least one edge of the flashing member is disposed below the flange of the window frame, door frame or the like, wherein water that has collected within a window frame, door frame or the like drains through the non-adhering portion of the flashing member.

Still another aspect of the present invention is to provide a method for flashing door frames, window frames or the like, wherein the frames have an outside bottom flange therealong and includes providing a flashing member comprising a polymer sheet including a first and a second side, a top and a bottom edge and two opposite sides. A sealant is applied to the second side of the flashing member to segment the second side such that the second side includes at least one non-sealed section surrounded by sealant on at least three sides thereof, wherein the non-sealed section is disposed at least partially along the bottom edge of the flashing member. The top edge of the flashing member is affixed to the outside flange of the door frame, window frame or the like, wherein water that has collected within a window frame or a door frame drains through the non-sealed section of the flashing member.

Yet another aspect of the present invention is to provide a method of flashing doors, windows and the like wherein the doors, windows and the like include at least a flange along a bottom edge thereof and includes providing a sealant and partially sealing with the sealant at least the bottom flange of the door or window to an outside bottom perimeter of a building construction face, below a construction aperture, wherein the portion of the flange which is not sealed defines at least one opening having two opposite sides. A flashing member comprising a top edge, a bottom edge and opposite side edges is provided and a sealant is applied to the flashing member along the top edge and the opposite side edges. The top edge of the flashing member is attached to an outside surface of the bottom flange. The flashing member is disposed over the opening and extends laterally beyond the opposite two sides of the opening, and vertically below the opening, thereby sealing the top edge and opposite side edges to the outside surface of the flange and the construction face, respectively. The bottom edge extends vertically below the opening a sufficient distance so as to prevent water from entering the opening, wherein the sufficient distance is determined by the wind speed the construction may face and is calculated as follows:

[Wind speed (miles/hour)]$^2$×0.00256 Velocity Pressure (pounds/ft$^2$), whereby Velocity Pressure (pounds/ft$^2$)× 0.192=Distance of vertical extension of flashing member (inches of water). The result, in inches of water, determines the amount of the vertical extension (in inches) the flashing member extends below the opening.

Still yet another aspect of the present invention is a flashing device for doors, windows and the like which is installed in a construction aperture, wherein the doors, windows and the like include at least a flange along a bottom edge thereof. The flange is disposed along a bottom perimeter of the construction aperture and extends along at least a portion of a face of the construction. The flashing device includes a flashing member further including a top edge, a bottom edge, opposite side edges and a first side. A sealant is disposed on the first side of the flashing member, at least interiorly of said top edge and opposite side edges, to define a sealant-free channel thereon, wherein the channel is surrounded by sealant on at least three sides thereof. The channel extends to the bottom edge of the flashing member. The top edge of the flashing member is disposed over the bottom flange of the door or window and the flashing member extends downward on the outside face of the construction, wherein the channel extends from at least an edge of the flange, vertically downward below the construction aperture, at least 2 inches.

Other objects, advantages and features of the invention will become apparent upon a consideration of the following detailed description, when taken in conjunction with the accompanying drawings. The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto.

In this respect, before explaining the preferred embodiment of the disclosure in detail, it is to be understood that the disclosure is not limited in its application to the details of the construction and the arrangements set forth in the following description or illustrated in the drawings. The flashing system of the present disclosure is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the appended claims.

As such, those skilled in the art will appreciate that the conception, upon which the disclosure is based, may readily be used as a basis for designing other structures, methods and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers and practitioners in the art who are not familiar with the patent or legal terms of phraseology, to learn quickly from a cursory inspection the nature and essence of the technical disclosure of the application. Accordingly, the Abstract is intended to define neither the invention nor the application, which is only measured by the claims, nor is it intended to be limiting as to the scope of the invention in any way.

These and other objects, along with the various features and structures that characterize the invention, are pointed out with particularity in the claims annexed to and forming a part of this disclosure. For a better understanding of the flashing system of the present disclosure, its advantages and the specific objects attained by its uses, reference should be had to the accompanying drawings and descriptive manner in which there are illustrated and described the preferred embodiments of the invention.

Therefore, while embodiments of the corner flashing system are herein illustrated and described, it is to be appreciated that various changes, rearrangements and modifications may be made therein, without departing from the scope of the invention as defined by the appended claims.

DETAILED DESCRIPTION OF THE PREFERRED EMBODIMENT

Figure 1:
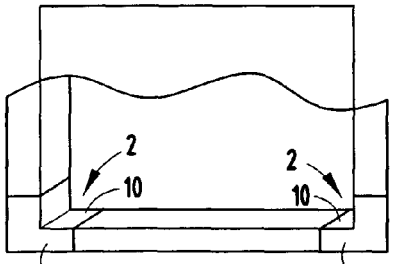
FIG. 1 is a perspective view of the corner flashing device according to a first embodiment of the present invention, in a typical construction frame.

The best mode for carrying out the invention is presented in terms of the preferred embodiment, wherein similar reference characters designate corresponding features throughout the several figures of the drawings.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in following specification, are simply exemplary embodiments. Hence, specific dimensions and other physical characteristics relating to the embodiments disclosed herein are not to be construed as limiting, unless expressly stated otherwise.

Figure 2:
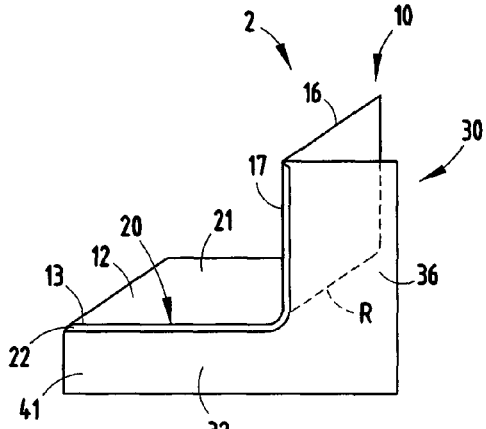
FIG. 2 is a perspective view of the corner flashing device of FIG. 1.

Referring now to the drawings, particularly FIG. 1, there is shown in perspective view a first embodiment of the inventive corner flashing device in use on an exemplary window frame construction. The corner flashing device 2 consists primarily of a first sill member 10 and a second face member 30 engaged along a continuous flange 22 to form the corner flashing device as illustrated in FIG. 2.

First sill member 10 includes a first section 12 comprising a first edge 13 and a second section 16 comprising a second edge 17. With respect to FIG. 3, first and second sections 12 and 16, respectively, are generally rectangular in shape wherein the first and second edges 13 and 17, respectively, are disposed adjacent to one another to define a first continuous edge 20 therealong. First and second edges 13 and 17 are disposed with respect to one another at an angle $\theta_1$ which equals the angle of the corresponding window frame structure wherein the corner flashing device is to be used. For example, when flashing a standard square window opening having four intersections which meet orthogonally, first section 12 will be disposed orthogonally to second section 16 to create an L-shaped sill member 10. However, this angle does not have to be orthogonal and sections 12 and 16 may be disposed at different angles to meet the specific requirements of the window construction. Further, first and second sections 12 and 16 need not be rectangular in shape but may take any shape as the specific requirements dictate. For example, first and second sections 12 and 16 may be the same length, different lengths and/or different geometries according to the specific requirements of the frame construction.

As described above, first and second sections 12 and 16 together define first sill member 10. Although first sill member 10 may be fabricated from two or more individual pieces, the preferred embodiment utilizes a single piece of material which is bent or angled to angle $\theta_1$ thereby forming a radius R along the vertex thereof. In the preferred embodiment, this radius is about ⅛ of an inch but may range in size to accommodate the specific requirements of the construction to be flashed. Sill member 10 also includes continuous edge 20 disposed along a front edge of sections 12 and 16, from which a first continuous flange 22 is formed as discussed below. First continuous flange 22 is formed from first member 10 by bending, creasing or otherwise folding over a continuous portion of edge 20 in a direction which extends away from a top surface 21 towards the opposite side thereof.

Sill member 10 may be fabricated from numerous materials. Generally, a flexible material is used such that sill member 10 is capable of conforming to and flashing the rough opening of a door, window, or the like. Such materials are commonly known within the art and may include, but are not limited to, polymer sheeting or film. The thickness of the sheeting or film may also vary according to the specific requirements of the construction. However, a preferred range is from about 2 mils (0.002 inches) to about 125 mils (0.125 inches), more preferably from about 3.5 mils (0.0035 inches) to about 40 mils (0.040 inches) and most preferably from about 5 mils (0.005 inches) to about 20 mils (0.020 inches). In a preferred embodiment, a virtually non-permeable high strength polyolefin sheet with a permeability of 0.3 perms or less is used and has an approximate thickness of 12 mils (0.012 inches). The method of fabricating sill member 10 is discussed hereinafter.

Figure 3:
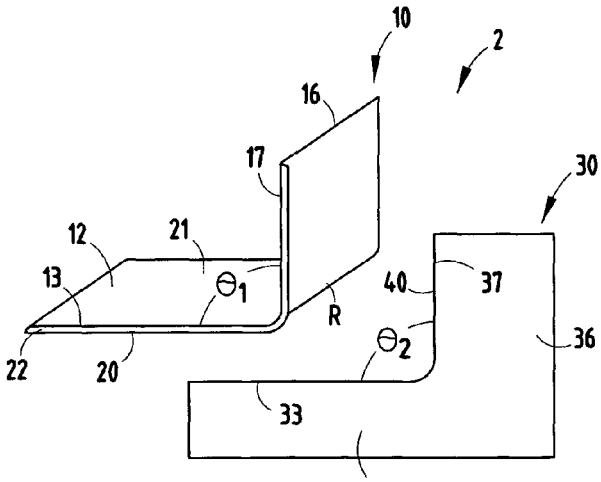
FIG. 3 is an exploded view of the corner flashing device of FIG. 2.

With respect to FIG. 3, second face member 30 includes a first section 32 comprising a third edge 33 and a second section 36 comprising a fourth edge 37. First and second sections 32 and 36, respectively, are generally rectangular in shape and the third and fourth edges 33 and 37, respectively, are disposed adjacent to one another to define a first continuous mating edge 40 therealong. Third and fourth edges 33 and 37 are disposed with respect to one another at an angle $\theta_2$. Angle $\theta_2$ generally equals angle $\theta_1$ of corresponding sill member 10. For example, when flashing a standard square window opening as discussed above, first section 32 and second section 36 will be planarly disposed creating an orthogonal angle $\theta_2$, thereby creating an L-shaped face member 30. However, this angle does not have to be orthogonal and sections 32 and 36 may be disposed at different angles to meet the specific requirements of the window construction. Further, first and second sections 32 and 36 need not be rectangular in shape but may take any shape as the specific requirements dictate. For example, first and second sections 12 and 16 may be the same length, different lengths and/or different geometries according to the specific requirements of the frame construction. Further yet, although face member 30 may be fabricated from two or more individual sections, the preferred embodiment utilizes a single piece of material which is fabricated having the specified angle $\theta_2$. By having angle $\theta_1$ and $\theta_2$ generally correspond to each other, continuous edge 40 of face member 30 may be affixed to continuous flange 22 of sill member 10 to form flashing device 2 as described hereinafter. As described above, angle $\theta_1$ and $\theta_2$ need only "generally correspond" in angle. The term "generally" as used herein means that the corresponding angles need not be exact, but are sufficiently close such that the two angled parts, and more particularly the angled flange and corresponding edge, may be affixed to one another without any openings or gaps therebetween. The amount of variance depends on, among other things, the amount of overlap, the length of the edge and manufacturing tolerances.

Figure 4:
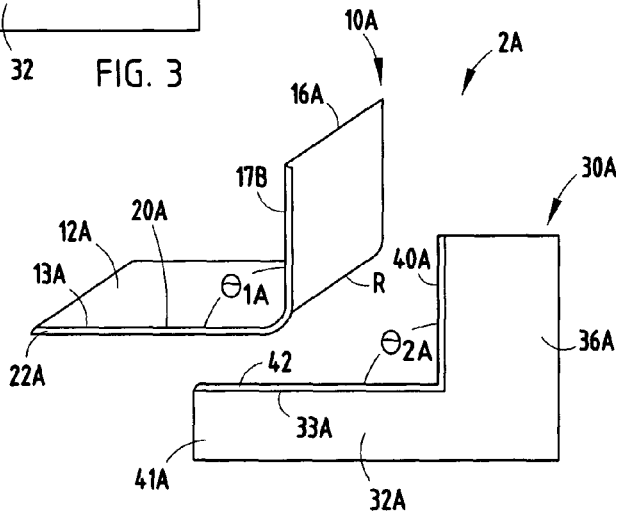
FIG. 4 is an exploded view of a second embodiment of a corner flashing device.

The reference numeral 2A (FIG. 4) generally designates another embodiment of the present invention having a continuous flange 42. Since window flashing device 2A is similar to the previously described window flashing device 2, similar parts appearing in FIGS. 1-3 and FIG. 4, respectively, are represented by the same, corresponding reference numeral, except for the suffix "A" in the numerals of the latter. In window flashing device 2A, face member 30A includes a second continuous flange 42 disposed along continuous edge 40A for interconnection with continuous flange 22A of sill member 10A. Second continuous flange 42 may be formed from second member 30A by bending, creasing or otherwise folding over a portion of the material along continuous edge 40A in a direction which extends away from a top surface 41A. In an alternative embodiment, second member 30A may solely include a flange for attachment to continuous edge 20A of first member 10A.

Face members 30 and 30A may be fabricated from numerous materials. As with sill member 10, a flexible material is used such that face members 30 and 30A are capable of conforming to and flashing the rough opening of a door, window, or the like. Such materials are commonly known within the art and may include, but are not limited to, polymer sheeting or film. Although face members 30 and 30A may be fabricated from a material which is different from the material of sill member 10, in the preferred embodiment the same virtually non-permeable high strength polyolefin sheet with a permeability of 0.3 perms or less and a thickness of 12 mils (0.012 inches) is used. The thickness of the sheeting or film may also vary according to the specific requirements of the construction. However, a preferred range is from about 2 mils (0.002 inches) to about 125 mils (0.125 inches), more preferably from about 3.5 mils (0.0035 inches) to about 40 mils (0.040 inches) and most preferably from about 5 mils (0.005 inches) to about 20 mils (0.020 inches). The method of fabricating face members 30 and 30A is discussed hereinafter.

Figure 5:
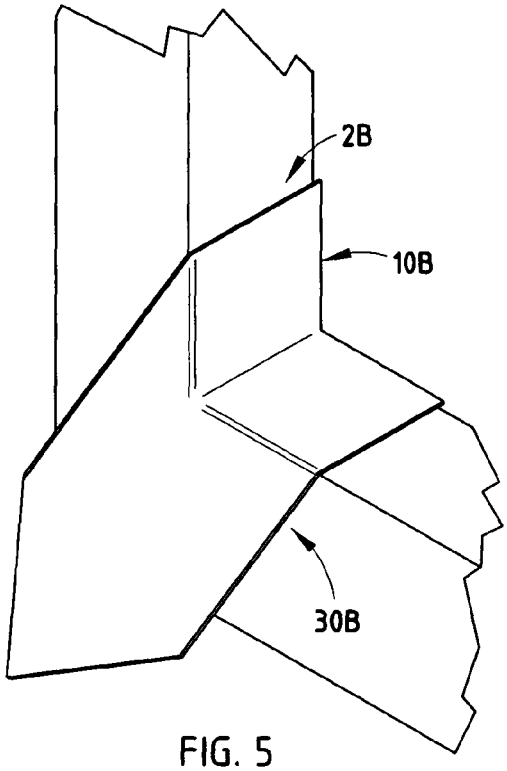
FIG. 5 is a fragmentary perspective view of a third embodiment of a corner flashing device in a typical construction frame.
Figure 6:
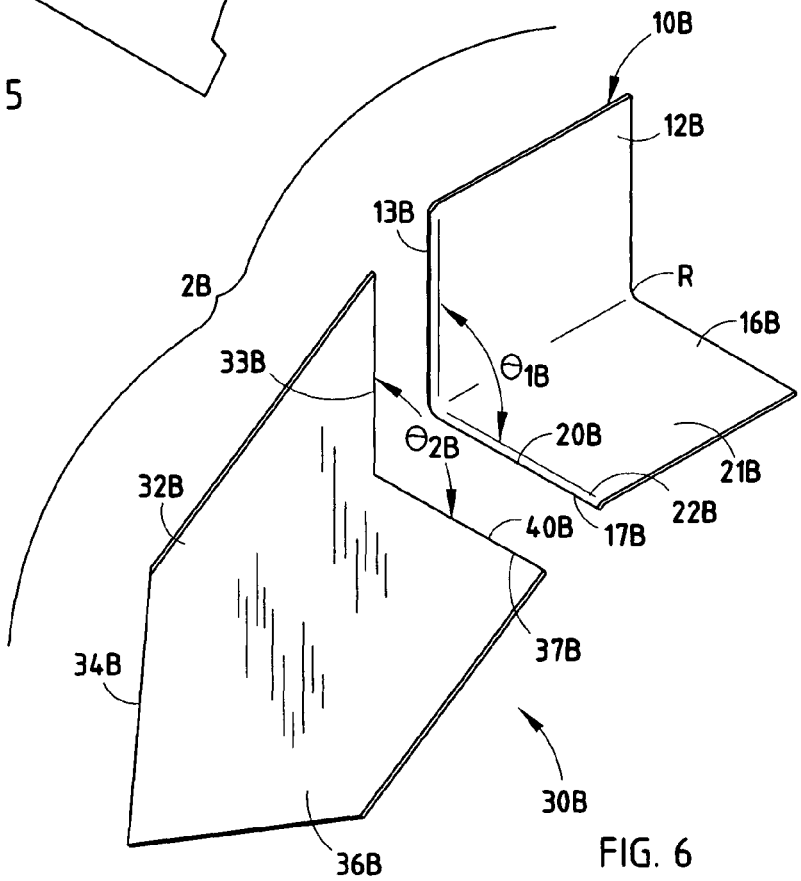
FIG. 6 is an exploded perspective view of the corner flashing device of FIG. 5.
Figure 7:
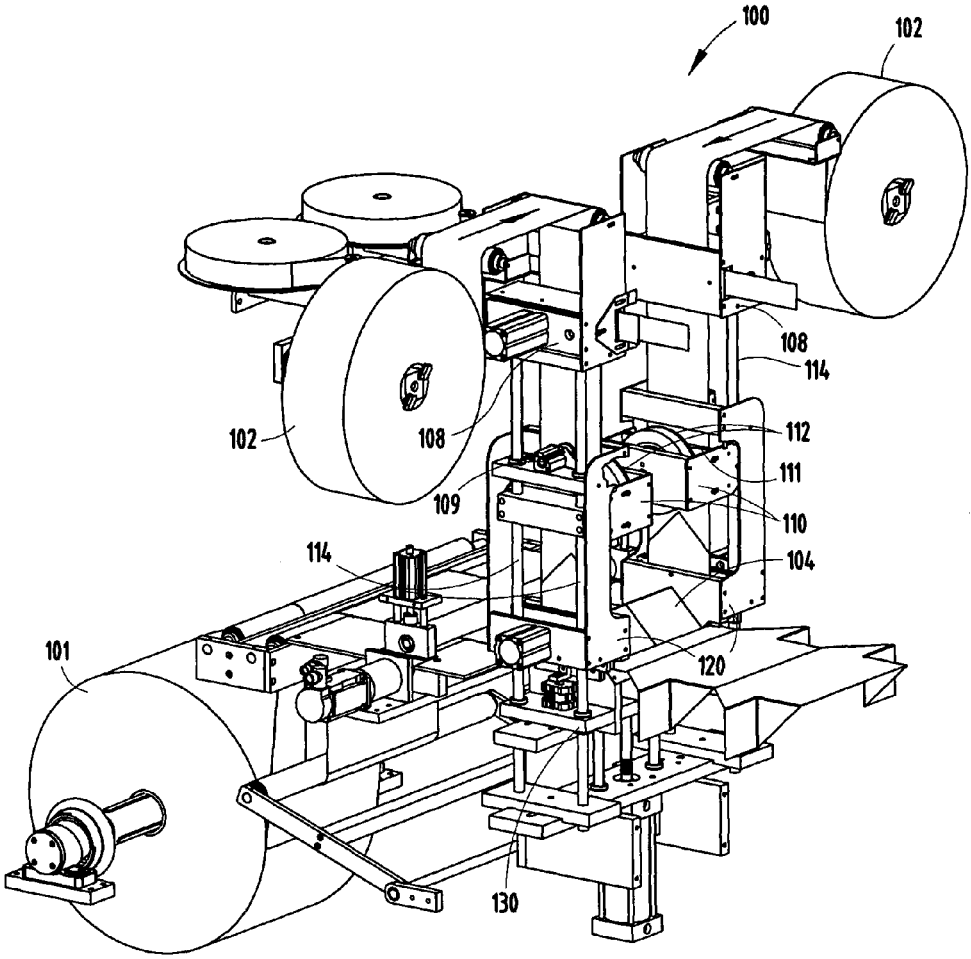
FIG. 7 is a perspective view of a machine used to fabricate the corner flashing device of FIG. 5.

The reference numeral 2B (FIG. 5) generally designates another embodiment of the present invention having a V-shaped member 30B. Since window flashing device 2B is similar to the previously described window flashing device 2, similar parts appearing in FIGS. 1-3 and FIGS. 5-6, respectively, are represented by the same, corresponding reference numeral, except for the suffix "B" in the numerals of the latter. In window flashing device 2B a first member 10B and a second member 30B are engaged along a continuous flange 22B of first member 10B (FIG. 6).

First member 10B includes a first section 12B comprising a first edge 13B and a second section 16B comprising a second edge 17B. With respect to FIG. 6, first and second sections 12B and 16B, respectively, are generally rectangular in shape and first and second edges 13B and 17B, respectively, are disposed adjacent to one another to define a first continuous edge 20B therealong. First and second edges 13B and 17B are disposed with respect to one another at an angle $\theta_1$B which equals the angle of the corresponding window frame structure wherein the corner flashing device is to be used. For example, when flashing a standard square window opening having four intersections, top and bottom sills and two side jambs, $\theta_1$B will generally be 90° enabling section 16B to be positioned against the sill of the construction frame and section 12B to be positioned against the side jamb of the construction frame. Of course, if the jamb and face of the construction were at an angle other than 90°, $\theta_1$B could be made to accommodate these custom angles as the specific requirements dictate. Further, first and second sections 12B and 16B need not be rectangular in shape but may take any shape as the specific requirements dictate. Further yet, although sill member 10B may be fabricated from two or more individual pieces, the preferred embodiment utilizes a single piece of material which is bent or angled to angle $\theta_1$B, thereby forming a radius R along the vertex thereof. In the preferred embodiment, this radius is about ⅛ of an inch but may range in size to accommodate the specific requirements of the construction to be flashed. First member 10B includes continuous edge 20B disposed along an edge of sections 12B and 16B, wherein a first continuous flange 22B is disposed. First continuous flange 22B is formed from first member 10B by bending, creasing or otherwise folding continuous edge 20B in a direction which extends away from a top surface 21B.

Second member 30B includes a generally trapezoidal first section 32B comprising third edge 33B and a generally trapezoidal second section 36B comprising fourth edge 37B. Third and fourth edge 33B and 37B are disposed adjacent one another to form a generally V-shaped continuous edge 40B having an angle $\theta_2$B. Second member 30B also includes bottom V-shaped edge section 34 having an angle $\theta_2$B. Angle $\theta_2$B is generally equal to angle $\theta_1$B and in the case of a standard construction frame, this angle would be generally 90° as illustrated by FIG. 5. Of course, angle $\theta_2$B may be varied to meet specific requirements. As described above with respect to the other embodiments, continuous V-shaped edge 40B, disposed along the upper edges of second member 30B, is interconnected with continuous flange 22B thereby forming window flashing device 2B.

The incorporation of V-shaped edge sections 40B and 34B to second member 30B allows window flashing device 2B to be fabricated with significantly reduced waste material. In the preferred embodiment this can be attributed to V-shaped continuous edge 40B of second member 30B having generally the same shape and angle as angled flange 22B. By having the same general shape, the material does not require cutting or trimming, either before or after the interconnection between first member 10B and second member 30B and therefore, waste material is reduced. Further, V-shaped edge 34 is also cut or otherwise shaped into the same general V-shape as opposite edge 40B. These opposite but similarly shaped end sections allow the part to be made, when using a continuous sheet, roll or other continuous process or material, from a single step or cut in the process. This is accomplished because as V-shaped edge section 34 is being cut, the remaining cut edge on the material is shaped as, and can therefore be used as, V-shaped edge section 40B of the subsequent part. Therefore, waste material is reduced, process steps are eliminated and productivity is increased by this unique V-shaped edge design.

As best illustrated by FIG. 5, second member 30B of window flashing device 2B is typically disposed on the construction frame such that member 30B is retained on or flashes the face of the construction frame, while member 10B flashes the sill and side joint of the construction. However, this is merely the preferred embodiment and flashing device 2B, and more particularly first member 10B and second member 30B, may be reversed, interchanged or otherwise disposed in numerous other configurations. In addition, window flashing device 2B may be fabricated from various materials and from various geometries as described above with regard to the previous embodiments.

The method of fabricating the various described embodiments is illustrated in FIGS. 7-12. Although reference will be made specifically to window flashing device 2B, the various other embodiments may be fabricated through similar techniques, devices and principles. With respect to FIG. 7, a fabrication and assembly machine 100 is shown and includes four primary stations comprising marking stations 108, cutting stations 110, folding/sealing stations 120 and plow stations 130, which simultaneously fabricate a pair of flashing devices 2B. A fifth gripping station 109 is also included to aid in the feeding of roll material 102 as described in more detail below. The overall configuration of the machine is as follows: a continuous roll of material 101 for fabricating a pair of first members 10B, and a pair of continuous rolls of material 102 for fabricating a pair of second members 30B, are disposed upstream of machine 100. The term upstream is meant to signify that the material is disposed before the machine in terms of the process sequence and does not necessarily signify the physical location. The material of continuous rolls 101 and 102 is routed, moved or otherwise transferred to their respective stations through systems and methods which are well known in the art. Further, machine 100 accomplishes many of the movements and actions herein described, simultaneously, as such, the system does not necessarily have a linear sequence of events. Therefore, the system will be described by reference to the various stations and the actions performed therein. It is also to be understood that various modifications may be made to the machine, its sequences, methods, orientations and the like without departing from the inventive concept and that the description contained below is merely a preferred embodiment and hence, not meant to be limiting unless stated otherwise. Further yet, when specific reference is made to first and second members 10B and 30B, their orientation, step sequences, processes and the like, it is to be understood that members 10B and 30B may used interchangeably.

Marking station 108 is the first station with respect to roll material 102 and transfers, embosses or otherwise leaves an image on a portion of roll material 102. For example, a logo can be heat stamped at this station. Roll material 102 is then fed to cutting station 110 (described below). At this station roll material 102 is cut into the desired shape using cutting head 112. In the preferred embodiment, a V-shaped edge having angle $\theta_2$B is cut. In this manner, a single cutting action creates the trailing edge 34 of second member 30B, which has forward edge 40B disposed within station 120, as well as creating leading edge 40B of the next second member 30B in the continuous process. Hence, a single cut creates edge 34B of the part in process and edge 40B of the part which is next in process.

Gripping station 109 and folding station 120 move up and down, along shafts 114, in unison, thereby assisting with the feeding of roll material 102 as follows. After cutting station 110 cuts roll material 102, by pressing cutting head 112 against a plate 111, gripping station 109 and folding station 120 descend simultaneously on shafts 114, and arrive at the position shown in FIG. 7. Gripping station 109, which is positioned above cutting station 110, in conjunction with folding station 120, which is positioned below cutting station 110, then activate or grip roll material 102, whereby gripping station 109 grips the uncut roll material 102 above cutting station 110 and folding station 120 grips the cut roll material 102 below station 110.

Figure 8:
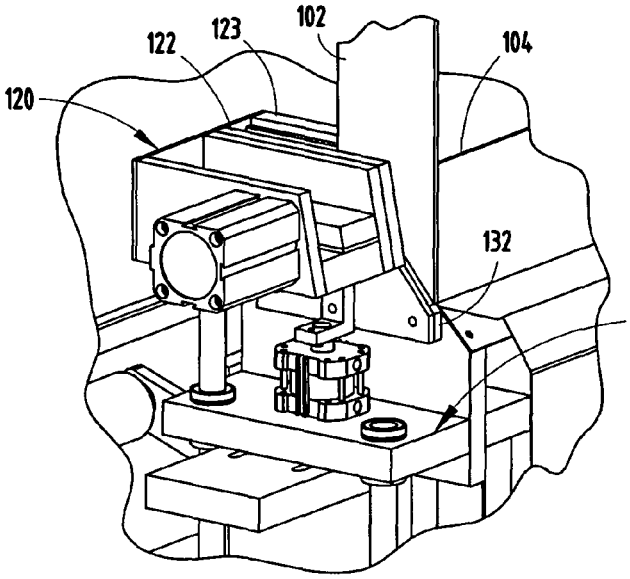
FIG. 8 is a partial perspective view of a folding station and a plow station portion of the machine of FIG. 7.
Figure 9:
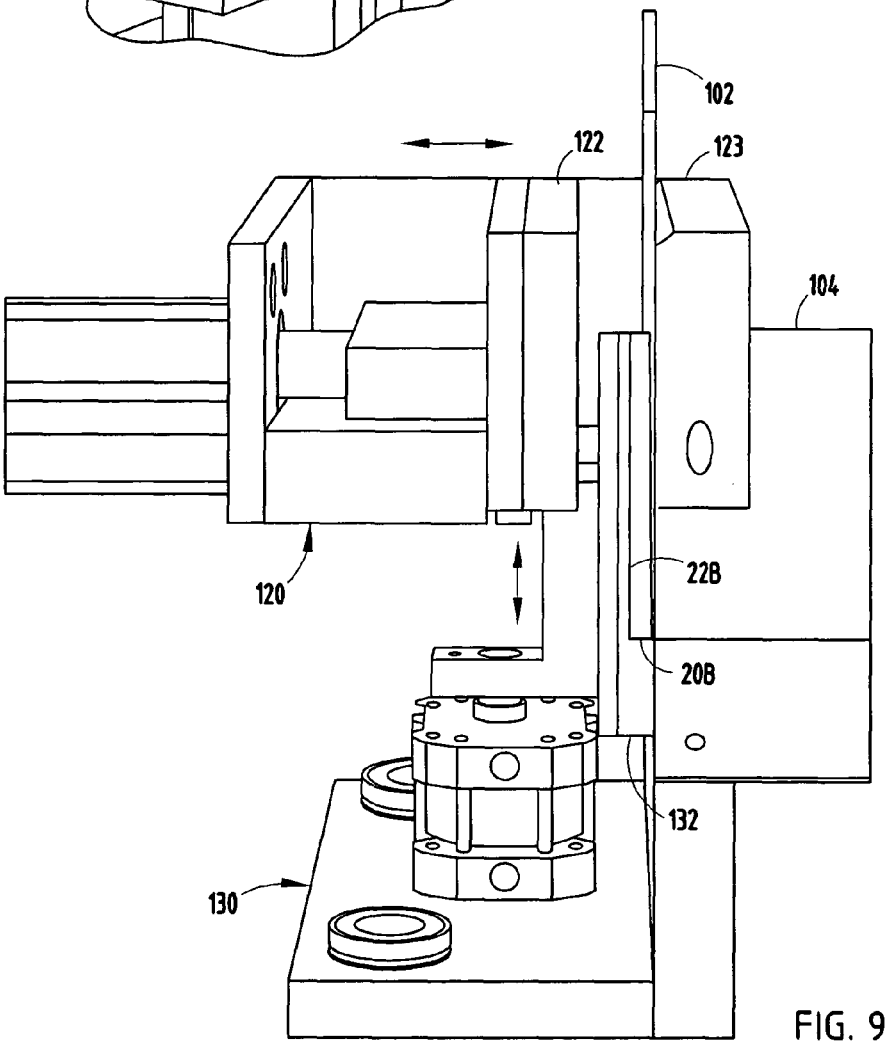
FIG. 9 is an front view of the folding station and plow station portion of FIG. 8.

Either subsequent to or concurrent with the above sequence, roll material 101 is moved forward thereby removing device 2B from station 120 and providing new material to station 120 for creating first member 10B by positioning material 101 underneath angle plate 104. Angle plate 104 is angled to the desired angle θ1B. With roll material 101 and 102 positioned within station 120, the folding and sealing operations take place. As best illustrated by FIGS. 8-9, roll material 101 is disposed such that edge 20B extends beyond angle plate 104. This exposed edge defines flange 22B. In the preferred embodiment, edge 20B extends beyond angle plate 104 approximately 0.25 inches.

Figure 10:
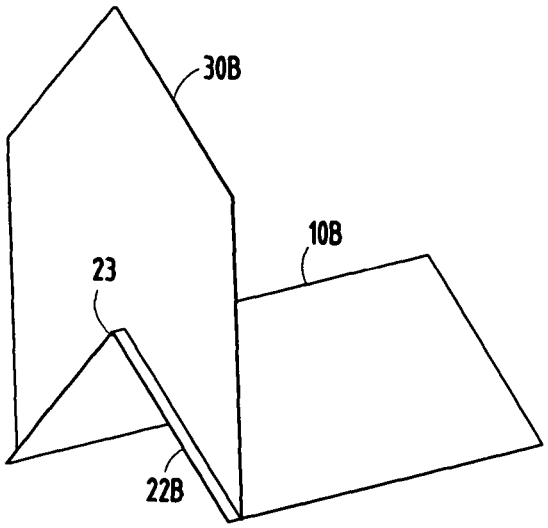
FIG. 10 is a perspective view of a first member and a second member of the corner flashing device of FIG. 5 prior to a folding and sealing step.
Figure 11:
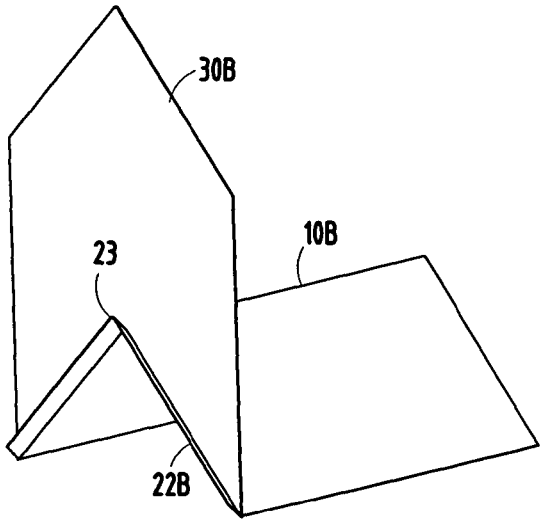
FIG. 11 is a perspective view of the first member and the second member of FIG. 10 during the folding and sealing step.
Figure 12:
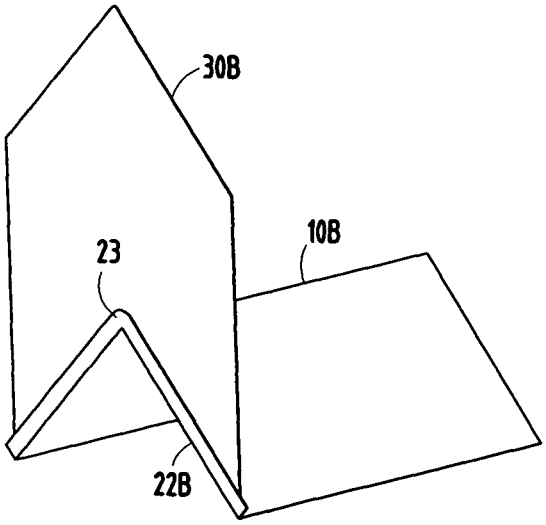
FIG. 12 is a perspective view of the first member and the second member of FIG. 10 after the folding and sealing step.

Once both members 10B and 30B, and more specifically flange 22B and edge 40B are positioned within folding/sealing station 120, a heater 122 is used to pre-heat flange 22B. Heater 122 will pre-heat flange 22B to a temperature necessary to foster pliability in flange 22B. In a preferred embodiment, this temperature is approximately 250 degrees Fahrenheit. The pre-heat treatment makes it possible for the material of flange 22B, more particularly the vertex 23 thereof, to stretch during the subsequent folding operation described below (FIGS. 10-12). After preheating, folding/sealing station 120 retracts, allowing plow station 130 which includes a V-shaped head 132 to travel upward (FIG. 9), wherein head 132 traverses over flange material 22B bending it over and forming the flange over edge 40B of roll material 102. The illustrative folding of flange 22B and formation over edge 40B is illustrated by FIGS. 10-12.

Positioned in or near plate 123 of station 120 is a heating device (not shown) that will then heat flange 22B and edge 40B, sealing flange 22B to edge 40B, thereby forming a continuous double layer joint. Although numerous methods can be used to join, affix or weld these edges together, in the preferred embodiment, heat sealing is advantageously utilized. In conjunction with the closing of folding/sealing station 120 to retain roll material 102, as well as apply pressure when flange 22B and edge 40B are affixed, cutting station 110 also closes to cut the opposite end of edge 34B of second member 30B as described previously. Stations 109 and 120 then move vertically upward and return to their original positions, and the process repeats. Various other operations, such as opening folding/sealing station 120, returning plow station 130, cutting roll material 101 and the like, which contribute to the fabrication of window flashing 2B, occur downstream of these operations and are not critical to the inventive concept. The resultant double layered seal provides increased strength creating a durable sealed edge which provides a continuous seal without the notches or various other openings exhibited by the prior art devices which may either initially, or over time, destroy the sealing capabilities of the flashing device.

The reference numeral 2C (FIG. 13) generally designates another embodiment of the present invention which includes a one-way valve member 50. Since window flashing device 2C is similar to the previously described window flashing device 2B, similar parts appearing in FIGS. 5-6 and FIGS. 13-16, respectively, are represented by the same, corresponding reference numeral, except for the suffix "C" in the numerals of the latter. In window flashing device 2C a valve member 50 is utilized in addition to flashing devices 2C which are installed in at least the lower two corners of the construction frame, between the side jambs and the lower sill.

As illustrated in FIGS. 13-16, the valve member 50 is generally a sheet of polymer 51 which is adhered or otherwise sealed to the outside lower flange of a window frame, door frame, or the like. With respect to FIG. 14, valve member 50 includes a sealed area 52 which surrounds a non-sealed area 54 on three sides thereof, whereby non-sealed area 54 extends to at least one edge 56 of valve member 50.

Figure 13:
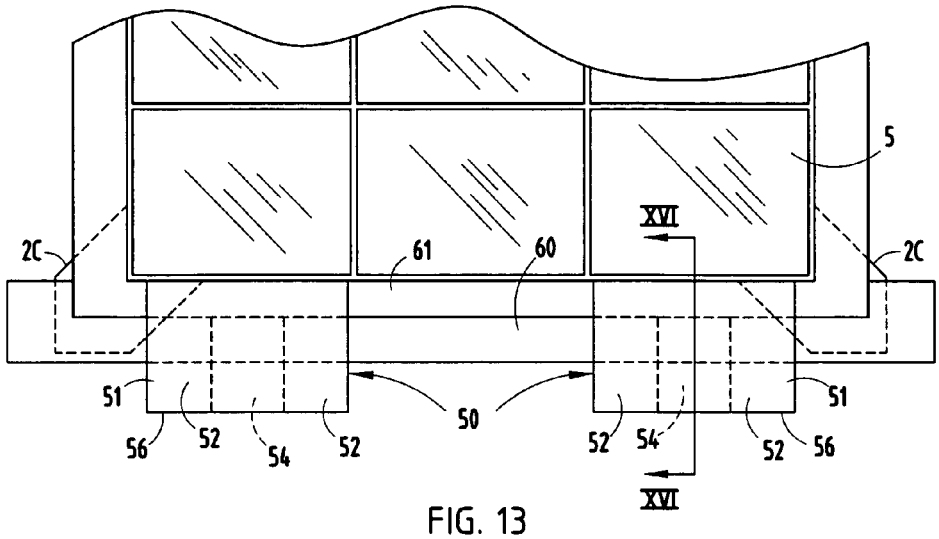
FIG. 13 is a front view of a valve flashing device according to a preferred embodiment of the present invention, in a typical construction frame.
Figure 16:
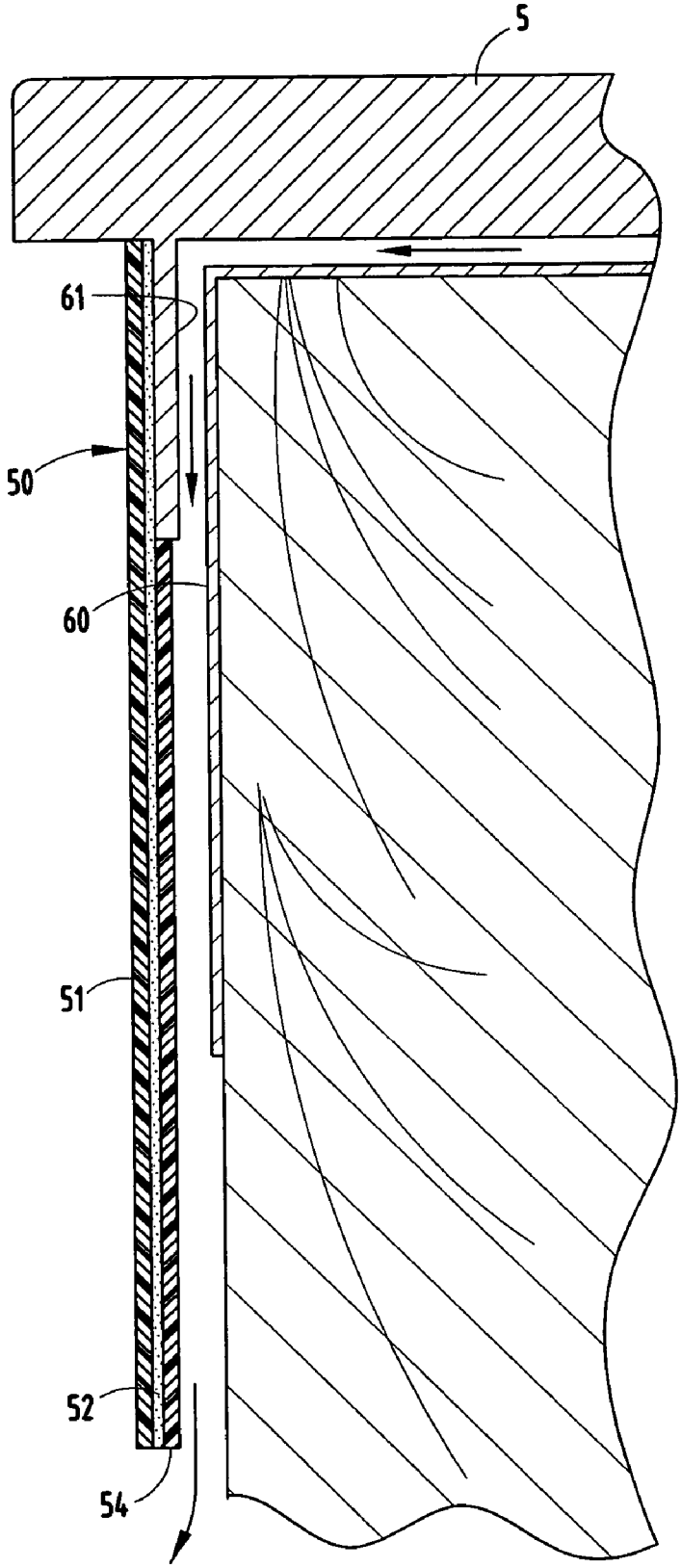
FIG. 16 is a partial cross-sectional view through line XVI-XVI of the construction of FIG. 13.

The installed valve member 50 is illustrated in FIGS. 13 and 16. Prior to the installation of valve member 50, window corner flashing devices 2C are installed in the construction frame. Each corner of the construction frame will typically include a corner flashing device 2C. A sill pan 60 is then installed and sealed over the corner flashing devices 2C disposed in the lower two corners of the construction frame and the corresponding sill. The sill pan 60 is installed such that it adheres, seals or covers the entire sill and extends downward, on the front outside of the sill, to prevent water from entering the construction. A window, door, or the like 5, which typically includes a flange 61 surrounding the frame, is then installed and completely sealed on the top and sides thereof. This is typically done by utilizing a caulk or other sealant on the frame between the frame of the window, door, or the like 5 and the structural aperture or construction opening. The lower sill area of the frame is then partially sealed to leave at least one small opening or gap in the sealant from which water may traverse therethrough.

The installation of valve member 50 is achieved by adhering or otherwise sealing the rear adhesive portion of valve member 50, along top edge 55, to the lower outside flanged member 61 of the installed window frame, door frame, or the like 5. Valve member 50 is positioned along the flange such that it resides over and covers the small opening or gap in the sealant of the sill while at least a portion of non-sealed area 54 either resides on or is adjacent to the lower edge of flange 61. As best illustrated in FIG. 16, valve member 50 and more particularly non-sealed area 54 extends downward from flange 61 along the outside face of the construction. In the preferred embodiment two sealant gaps are used on the sill, each approximately one inch wide, and a pair of valve members 50 are used and include approximately a two inch wide non-sealed area which extends approximately three inches down the front face of the construction. In another preferred embodiment, a single gap is used an disposed centrally with respect to the bottom window flange and a single valve member 50 is utilized.

The installed valve member 50 inventively creates a one-way valve member which, while not allowing water into the construction from the outside, allows water that has entered the construction to be drained therefrom as illustrated by the arrows in FIG. 16. This one-way valve design is accomplished through the use of non sealed area 54 of valve member 50.

When a sill pan 60 is used in typical flashing installations, the sill pan 60 is affixed or sealed to the sill of the construction providing what is to be a barrier between the window, door or the like 5, and the corresponding construction. However, the seal, which is typically achieved by caulking, sealant, adhesives and the like, generally does not achieve 100% wet out or adhesion along the entire perimeter of the window or door and thus, un-sealed areas or channels are created which can provide paths from which water can enter into the construction. Additionally, water may enter the construction through various other routes such as leaks in the window or door. For example, through separated frame components, broken flanges, glass/frame interfaces as well as gaps in the flange perimeter sealant. The water typically enters the construction due to a pressure differential that is created between the inside and outside of the completed construction. This pressure difference can be created, for example, by wind pressure. Advantageously, these channels allow the water which has collected to drain once the higher outside pressure has been removed. The primary purpose of sealing members 50 is to allow for necessary drainage in the sill pan system while at the same time preventing water ingress through the same opening by acting as a one-way valve to eliminate or greatly reduce the pressure differential that could cause water to migrate inward to the interior side of the wall.

It has been inventively discovered that when valve member 50 is installed as described above, water is not allowed into the construction, yet any water that has entered the construction through other areas, for example through a window leak, may be drained through non sealed area 54. This one-way-valve design is accomplished by providing valve member 50 with the non-sealed area 54 which is vertically disposed to provided a channel 54, wherein any water that has collected on the inside of the construction may drain to the outside through the sealant gap and down channel 54. However, by utilizing this vertical orientation of valve member 50, for water to enter the construction it must flow vertically upward, underneath valve member 50 and into non-sealed area 54. The amount of pressure that it takes for water to travel vertically upward through the channel formed by non-sealed area 54 depends upon the amount of vertical overhang, or vertical dimension of non-sealed area 54. The required vertical dimension, in inches, must be a sufficient dimension so as to prevent water from migrating up the non-sealed area and into the opening by the aforementioned pressure of difference. Therefore, the vertical dimension must exceed the pressure difference between the inside of construction and the outside thereof at the opening. The sufficient distance can be calculated by determining the maximum wind speed the construction will face as described below. The required vertical dimensions, in inches, must exceed the gap opening expressed in units of inches of water. The velocity pressure can be derived from wind speed by utilizing the following equations:

$$\text{Velocity pressure (pounds/ft}^2\text{)} = 0.00256 \times [\text{Wind Speed (miles per hour)}]^2; \quad 1)$$

$$\text{Distance} = \text{inches of water} = 0.192 \times \text{velocity pressure (pounds/ft}^2\text{)}; \quad 2)$$

For example, at a wind speed of 75 MPH: Velocity Pressure=0.0.00256×[75]$^2$=14.4 pounds/ft$^2$ and Vertical Distance=0.192×14.4=2.76 inches of water. Therefore, at least a 2.76 inch vertical overhang is required to withstand this wind speed. It has been demonstrated that when using a 3.0 inch vertical overhang and a 2.0 inch wide non-sealed area, a pressure of 15.0 pounds-per-square-foot can be sustained without allowing water to travel into the construction. This equates to a wind speed of over 79 miles-per-hour. Therefore an effective one-way-valve flashing design has been developed which restricts water from entering the construction while allowing any water that has entered to be drained away to the outside.

Valve member 50 may be fabricated from numerous materials. Generally, a flexible material is used such that valve member 50 is capable of conforming to and flashing the construction opening of a window sill, door sill, or the like. Such materials are commonly known within the art and may include, but are not limited to, polymer sheeting and films. The thickness of the sheeting or film may also vary according to the specific requirements of the construction. However, a preferred range is from about 2 mils (0.002 inches) to about 125 mils (0.125 inches), more preferably from about 3.5 mils (0.0035 inches) to about 40 mils (0.040 inches) and most preferably from about 5 mils (0.005 inches) to about 20 mils (0.020 inches). In a preferred embodiment a virtually non-permeable high strength polyolefin sheet with a permeability of 0.3 perms or less is used having an approximate thickness of 12 mils (0.012 inches). The adhesive of valve member 50 may also be fabricated from numerous materials. Generally, a pressure sensitive adhesive is preferred. For example, a modified asphalt or butyl rubber based adhesive may be used. Such a material is available as Moistop E-Z Seal® as mentioned previously. Further, the Moistop E-Z Seal® includes an adhesive backed side that can be used to create sealed areas 52 while non sealed area 54 can be created by leaving a portion of the release liner, attached to protect the adhesive layer, thereon. Although a non permeable material has been discussed with particularity, a permeable polymer could also be used for valve member 50 to provide additional avenues of escape for collected water.

Figure 14:
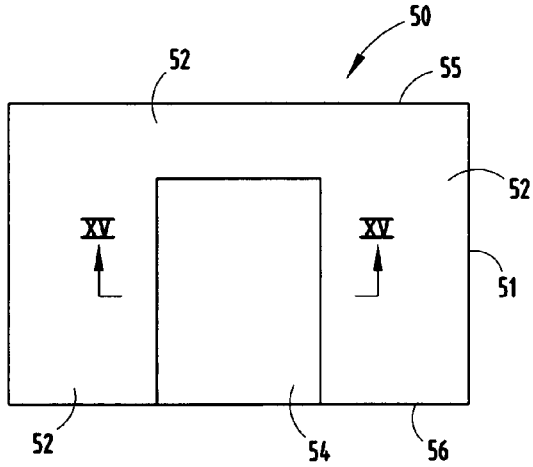
FIG. 14 is a bottom view of the flashing device of FIG. 13.
Figure 15:
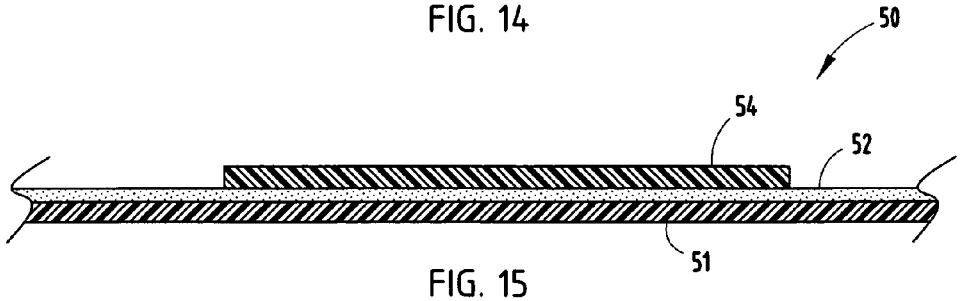
FIG. 15 is a partial cross-sectional view of the flashing device of FIG. 14 taken along line XV-XV of FIG. 14.

Although an adhesive back material has been exemplarily described, the one-way valve concept can also be achieved with other materials and sealing methods. For example, separately applying caulking or sealant to create flashing member 50. In this embodiment, the caulking or sealant is applied, on site, to a second face of a polymer sheet or film. This may be accomplished by completely covering an area 52 with a sealant and leaving area 54 unsealed or free of the sealant, or by providing a caulking bead or seam along a perimeter of non-sealed area 54, thereby creating non-sealed area 54 by segmenting flashing member 50 into the sealed and non-sealed areas as illustrated by FIG. 14.

Another embodiment of the one-way valve design can be fabricated by:

1) initially sealing a door frame, window frame or the like on all sides except for a portion of the bottom of the frame, wherein the portion of the frame which is not sealed defines an opening having two opposite sides;

2) utilizing a polymer flashing member, with no adhesive or sealant thereon, the flashing member comprising a top edge, a bottom edge and opposite side edges;

3) sealingly attaching the top edge of the flashing member to a bottom outside flange of a window frame, door frame or the like, over the opening, whereby the flashing member extends laterally beyond the opposite two sides of the opening. The seal between the top edge and the outside flange may be, for example, a bead of caulking;

4) sealingly attaching the flashing member between each of the opposite side edges to a face of a construction aperture, below a window frame, door frame or the like. The seal between the opposite side edges may be, for example, a bead of caulking; and 5) extending the bottom edge below the opening from about 1 inch, more preferably about 2 inches and most preferably about 3 inches.

In this manner, a polymer sheet can be used to create a one way valve without the necessity of additional sealant being manufactured thereon. This fabrication allows water that has collected within the construction to drain through the flashing member, while keeping water from entering the construction in the first place.

The reference numeral 70 (FIG. 17) generally designates another embodiment of the present invention which includes an integral sill pan member 60D. Since window flashing device 2D is similar to the previously described window flashing device 2B, similar parts appearing in FIGS. 5-6 and FIG. 17, respectively, are represented by the same, corresponding reference numeral, except for the suffix "D" in the numerals of the latter. In window flashing device 70 a pair of corner flashing members 2D are integrally fabricated to include a sill pan flashing member 60D.

Figure 17:
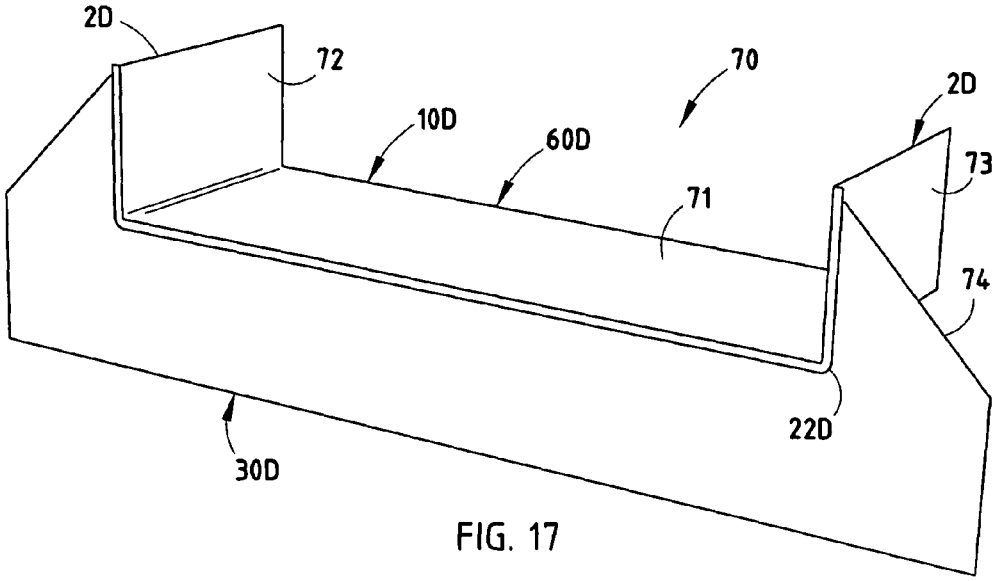
FIG. 17 is a perspective view of a pair of corner flashing devices incorporated into a sill pan flashing member according to yet another embodiment of the present invention.
Figure 18:
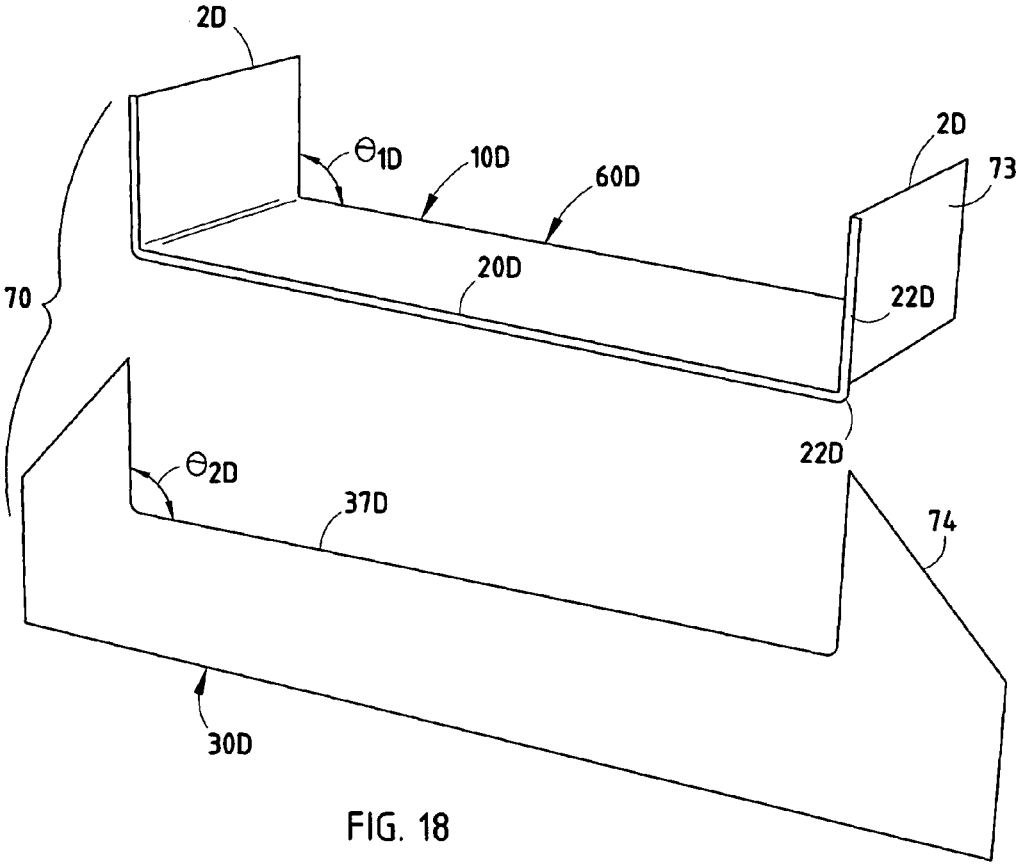
FIG. 18 is an exploded perspective view of the flashing device of FIG. 17.

With reference to FIG. 17, flashing device 70 includes a first member 10D and a second member 30D integrally attached by a continuous flange 22D disposed along one or both continuous edges 20D and 37D of first and second members 10D and 30D, respectively. In the preferred embodiment, flange 22D is disposed along first continuous edge 20D of first member 10D. Flange 2D may be formed from first member 10D by bending, creasing or otherwise folding over a portion of the material along continuous edge 20D as described with regard to the aforementioned embodiments.

The first member 10D comprises a first generally planar portion 71 and a pair of upstanding portions 72 and 73, thereby defining a generally U-shaped first member 10D. In the preferred embodiment, upstanding portions 72 and 73 are fabricated by bending, creasing or otherwise folding generally planar portion 71 on opposite ends thereof to create the generally U-shaped configuration with end sections 72 and 73 disposed at an angle $\theta_1$D. Second member 30D includes a generally planar portion 74 including edge 37D which is shaped or cut to correspond in shape to edge 20D of first member 10D, thereby having angled sections $\theta_2$D, wherein $\theta_1$D generally equals $\theta_2$D. In the preferred embodiment, portion 74 is cut to form a corresponding generally U-shaped member 30D, including edge 37D, which corresponds in shape and size to edge 20D of member 10D. First member 10D is attached to second member 30D by a continuous flange 22D which is fabricated on edge 20D by bending, creasing or otherwise folding the edge 20D as described previously. Of course, a continuous flange 22B may also be disposed along continuous edge 37B and further, a pair of flanges (not shown) may also be used, wherein each edge 20D and 37D has a flange disposed thereon.

In use, flashing member 70 provides a single flashing member that simultaneously provides corner flashing and sill flashing of a window, door, or the like with a single part. In use, flashing device 70 is manufactured to have a length equal to the sill member of the window or door it is designed to flash, thereby requiring flashing members of different lengths for different sized windows. However, this can inventively be avoided by cutting flashing device 70 in half, through sill portion 60D. In this respect, if the flashing device is too long, sill portion 60D can be either cut further, or overlapped to fit the corresponding frame. Alternately, when the flashing device is too short for the frame, a cut is made as described above and allows the corner pieces 2D to be disposed in two corners of the frame, thereby providing a pair of longitudinally extended flashing devices 2D to each lower corner of the frame wherein the middle section of the sill, disposed between each section 2D, remains unflashed. This middle section of the sill can either be left unflashed or flashed with an additionally flashing member (not shown).

Flashing device 70 may be manufactured utilizing the same methods and materials as with regard to the aforementioned flashing devices. In particular, a flexible material is typically used. Such materials are commonly known within the art and may include, but are not limited to, polymer sheeting and/or film. Although members 10D and 30D may be fabricated from dissimilar materials, in the preferred embodiment the same, virtually non-permeable high strength polyolefin sheet with a permeability of 0.3 perms or less, is used. In the preferred embodiment, the method of fabricating flashing device 70 is similar to the method for creating flashing device 2B as discussed in detail previously. Further, as described with regard to the other embodiments, flashing device 70 may be made with varying geometries and angles to accommodate differing window frame constructions as previously described.

The solutions offered by the invention herein have thus been attained in an economical, practical, and facile manner. To wit, an effective and convenient flashing device includes a continuous flange that eliminates gaps thereby preventing leaks, a method for fabricating the flashing device and a one-way valve flashing member to allow water out of a construction but not into it. While preferred embodiments and example configurations of the invention have been herein illustrated, shown and described, it is to be appreciated that various changes, rearrangements and modifications may be made therein, without departing from the scope of the invention as defined by the appended claims. It is intended that the specific embodiments and configurations disclosed are illustrative of the preferred and best modes for practicing the invention, and should not be interpreted as limitations on the scope of the invention as defined by the appended claims and it is to be appreciated that various changes, rearrangements and modifications may be made therein, without departing from the scope of the invention as defined by the appended claims.

The invention claimed is:

1. A flashing device comprising:

a first member having a first section disposed adjacent a second section and angled thereto, the first section and second section having a first edge and second edge, respectively, the first member further comprising a first continuous flange disposed along the first and second edges of the first and second sections, respectively; and a second member comprising a first section having a third edge and a second section having a fourth edge, the first section and the second section of the second member being substantially located along a plane, the second member further comprising a first continuous mating edge disposed along the third and fourth edges thereof;

wherein the first continuous flange is permanently affixed to the third and fourth edges of the first continuous mating edge.

2. The flashing device of claim 1, wherein the first member is generally L-shaped.

3. The flashing device of claim 2, wherein the second member is generally L-shaped.

4. The flashing device of claim 1, wherein the first continuous flange is thermally bonded to the first continuous mating edge.

5. The flashing device of claim 1, wherein the first and second members are polyolefin.

6. The flashing device of claim 5, wherein the first and second members have a permeance of 0.3 perms or less.

7. A flashing device for doors, windows and the like comprising:

a first flashing member comprising a first section including a first edge and a second section including a second edge, the first and second edges disposed adjacently to define a first continuous edge therealong, the first section disposed at a first angle with respect to the second section;

a second flashing member including a first section having a third edge and second section having a fourth edge, the first section and the second section of the second flashing member being substantially located along a plane, the third edge disposed at a second angle with respect to the fourth edge, the second angle generally equal to the first angle, the third and fourth edges adjacently disposed to define a second continuous edge; and a continuous flange disposed along both the first and second edges of the first continuous edge;

wherein the continuous flange disposed along the first continuous edge is affixed to the third and fourth edges of the second continuous edge.

8. The flashing device of claim 7, wherein the first flashing member is generally L-shaped.

9. The flashing device of claim 8, wherein the second flashing member is generally L-shaped.

10. The flashing device of claim 7, wherein the continuous flange is thermally bonded to the first or second continuous edge.

11. The flashing device of claim 7, wherein the first and second flashing members are polyolefin.

12. The flashing device of claim 11, wherein the first and second flashing members have a permeance of 0.3 perms or less.

13. The flashing device of claim 7, wherein the flange extends over a portion of the second continuous edge.

14. A flashing device for doors, windows and the like comprising:

a first flashing member comprising a first section including a first edge, and a second section including a second edge, the first and the second edges disposed adjacently to define a first continuous edge therealong, the first section disposed generally orthogonally with respect to the second section;

a second flashing member including a first section having a third edge and a second section having a fourth edge, the first section and the second section of the second flashing member being substantially located along a plane, the third edge disposed generally orthogonal to the fourth edge, the third and fourth edges adjacently disposed to define a second continuous edge therealong; and a continuous flange disposed along both the first and second edges of the first continuous edge;

wherein the continuous flange disposed along the first continuous edge is affixed to the third and fourth edges of the second continuous edge such that the first flashing member may be disposed generally orthogonal to the second flashing member.

15. The flashing device of claim 14, wherein the first flashing member is generally L-shaped.

16. The flashing device of claim 15, wherein the second flashing member is generally L-shaped.

17. The flashing device of claim 14, wherein the continuous flange is thermally bonded to the second continuous edge.

18. The flashing device of claim 14, wherein the first and second flashing members are polyolefin.

19. The flashing device of claim 18, wherein the first and second flashing members have a permeance of 0.3 perms or less.

20. The flashing device of claim 14, wherein the flange extends over a portion of the second continuous edge.

21. A flashing device for doors, windows and the like comprising:

a first flashing member comprising a first section including a first edge, and a second section including a second edge, the first and second edges disposed adjacently to define a first continuous edge therealong, the first section disposed at a first angle with respect to the second section;

a second flashing member comprising a third section including a third edge, and a fourth section including a fourth edge, the third section and the fourth section of the second flashing member being substantially located along a plane, the third and fourth edges disposed adjacently to define a second continuous edge therealong, the third edge disposed at a second angle with respect to the fourth edge; and a continuous flange disposed along both the first and second edges of the first continuous edge;

wherein the continuous flange disposed along the first continuous edge is affixed to the third and fourth edges of the second continuous edge.

22. The flashing device of claim 21, wherein the first flashing member is generally L-shaped.

23. The flashing device of claim 22, wherein the second flashing member is generally V-shaped.

24. The flashing device of claim 21, wherein the second flashing member is generally V-shaped.

25. The flashing device of claim 21, wherein the continuous flange is thermally bonded to the second continuous edge.

26. The flashing device of claim 21, wherein the first and second flashing members are polyolefin.

27. The flashing device of claim 26, wherein the first and second flashing members have a permeance of 0.3 perms or less.

28. The flashing device of claim 21, wherein the flange extends over a portion of the second continuous edge.

29. A flashing device for doors, windows and the like comprising:

a first flashing member comprising a first section including a first edge, and a second section including a second edge, the first and second edges disposed adjacently to define a first continuous edge therealong, the first section disposed at a generally orthogonal angle with respect to the second section;

a second flashing member comprising a third section including a third edge, and a fourth section including a fourth edge, the third section and the fourth section of the second flashing member being substantially located along a plane, the third and fourth edges disposed adjacently to define a second continuous edge therealong, the third section disposed at a generally orthogonal angle with respect to the fourth section; and a continuous flange disposed along both the first and second edges of the first continuous edge;

wherein the continuous flange disposed along the at first continuous edge is affixed to the third and fourth edges of the second continuous edge such that the first flashing member may be disposed generally orthogonal to at least part of the second flashing member.

30. The flashing device of claim 29, wherein the first flashing member is generally L-shaped.

31. The flashing device of claim 30, wherein the second flashing member is generally V-shaped.

32. The flashing device of claim 29, wherein the second flashing member is generally V-shaped.

33. The flashing device of claim 29, wherein the continuous flange is thermally bonded to the first or second continuous edge.

34. The flashing device of claim 29, wherein the first and second flashing members are polyolefin.

35. The flashing device of claim 34, wherein the first and second flashing members have a permeance of 0.3 perms or less.

36. The flashing device of claim 29, wherein the flange extends over a portion of the second continuous edge.

37. A flashing device for doors, windows and the like comprising:

a first flashing member comprising a first section including a first edge, a second section including a second edge and a third section including a third edge, the first, second and third edges disposed adjacently to define a first continuous edge therealong, the first and second sections disposed at a first angle with respect to the third section;

a second flashing member including a fourth, a fifth and a sixth edge, the fourth and fifth edges disposed at a second angle with respect to the sixth edge, the second angle generally equal to the first angle, the fourth, fifth and sixth edges adjacently disposed to define a second continuous edge; and a continuous flange disposed along the first continuous edge;

wherein the continuous flange disposed along the first continuous edge is affixed to the fourth, fifth and sixth edges of the second continuous edge.

38. The flashing device of claim 37, wherein the first flashing member is generally U-shaped.

39. The flashing device of claim 38, wherein the second flashing member is generally U-shaped.

40. The flashing device of claim 37, wherein the first continuous flange is thermally bonded to the second continuous edge.

41. The flashing device of claim 37, wherein the first and second flashing members are polyolefin.

42. The flashing device of claim 41, wherein the first and second flashing members have a permeance of 0.3 perms or less.

43. The flashing device of claim 37, wherein the flange extends over a portion of the second continuous edge.

44. A method of creating a flashing device for doors, windows and the like comprising:

providing a first flashing member comprising a first section including a first edge and a second section including a second edge;

disposing the first and second edges adjacently to define a first continuous edge therealong;

disposing the first section at a first angle with respect to the second section;

disposing a continuous flange along both the first and second edges on the first continuous edge;

providing a second flashing member including first section having a third edge and second section having a fourth edge, the first section and the second section of the second flashing member being substantially located along a plane;

disposing the third edge at a second angle with respect to the fourth edge, with the second angle generally equal to the first angle;

disposing the third and fourth edges adjacently to define a second continuous edge; and affixing the continuous flange disposed along the first continuous edge to the third and fourth edges of the second continuous edge.

45. The method of claim 44, further comprising:

bending the first section to the first angle with respect to the second section.

46. The method of claim 45, wherein the first flashing member is generally L-shaped.

47. The method of claim 46, wherein the second flashing member is generally L-shaped.

48. The method of claim 45, wherein affixing comprising thermally bonding.

49. The method of claim 45, wherein the first and second flashing members are polyolefin.

50. The method of claim 45, wherein the first and second flashing members have a permeance of 0.3 perms or less.

51. The method of claim 44, further including:

heating at the first continuous edge to thereby form the continuous flange.

52. The method of claim 44, further including:

bending the first section to a first angle with respect to the second section;

cutting the third section and the fourth section to define a V-shaped notch comprising the third edge and a fourth edge;

heating at the first continuous edge to thereby from the continuous flange.

53. The flashing device of claim 1, wherein:

the second member includes a second continuous flange along the third edge and the fourth edge.

54. The flashing device of claim 7, wherein:

the second flashing member includes a second continuous flange along the third edge and the fourth edge.

55. The flashing device of claim 14, wherein:

the second flashing member includes a second continuous flange along the third edge and the fourth edge.

56. The flashing device of claim 21, wherein:

the second flashing member includes a second continuous flange along the third edge and the fourth edge.

57. The flashing device of claim 29, wherein:

the second flashing member includes a second continuous flange along the third edge and the fourth edge.

* * * * *

UNITED STATES PATENT AND TRADEMARK OFFICE

CERTIFICATE OF CORRECTION

PATENT NO. : 7,788,855 B2
APPLICATION NO. : 10/870746
DATED : September 7, 2010
INVENTOR(S) : Mileti et al.

It is certified that error appears in the above-identified patent and that said Letters Patent is hereby corrected as shown below:

Column 5

Line 43, "0.00256 Velocity" should be --0.00256 = Velocity--.

Signed and Sealed this

Twenty-sixth Day of October, 2010

David J. Kappos

David J. Kappos
*Director of the United States Patent and Trademark Office*